United States Patent [19]

Amann et al.

[11] Patent Number: 4,652,055

[45] Date of Patent: Mar. 24, 1987

[54] DEVICE FOR COLLECTING MANGANESE NODULES ON THE OCEAN FLOOR

[75] Inventors: Hans Amann; Axel Bath, both of Hanover, Fed. Rep. of Germany

[73] Assignee: Preussag Aktiengesellschaft, Fed. Rep. of Germany

[21] Appl. No.: 766,534

[22] Filed: Aug. 19, 1985

[51] Int. Cl.[4] ..... E02F 3/92

[52] U.S. Cl. ..... 299/8; 37/DIG. 8; 209/390

[58] Field of Search ..... 37/DIG. 8, 54, 57, 66, 37/55; 299/8, 9; 209/390, 380, 274; 171/129

[56] References Cited

U.S. PATENT DOCUMENTS

| | | | |
|---|---|---|---|
| 532,183 | 1/1895 | Pike | 37/66 X |
| 3,456,371 | 7/1969 | Graham et al. | 37/DIG. 8 |
| 3,556,598 | 1/1971 | Smith | 37/66 X |
| 3,697,134 | 10/1972 | Murray | 37/DIG. 8 |
| 3,746,099 | 7/1973 | Black | 15/83 X |
| 3,999,313 | 12/1976 | Andrews | 299/8 X |
| 4,232,903 | 11/1980 | Welling et al. | 37/DIG. 8 |
| 4,343,098 | 8/1982 | Balligand et al. | 37/DIG. 8 X |
| 4,408,404 | 10/1983 | Latimer | 37/58 |

FOREIGN PATENT DOCUMENTS

| | | | |
|---|---|---|---|
| 61628 | 4/1984 | Japan | 37/66 |
| 2033944 | 5/1980 | United Kingdom | 37/DIG. 8 |

*Primary Examiner*—Clifford D. Crowder

*Attorney, Agent, or Firm*—Allegretti, Newitt, Witcoff & McAndrews, Ltd.

[57] ABSTRACT

A device for collecting manganese nodules or the like from the ocean floor having a frame that is drawn across the ocean floor, a cylinder rotating around a horizontal axis which has on its circumference brushes for picking up manganese nodules in the circumferential direction. A screen surrounds the rear half of the cylinder. Hook-like rods mounted on the screen terminate in prongs pointing in the traction direction for digging out manganese nodules. The bristles can be made of bronze and are in the form of ribs running in the axial direction of the cylinder. Because of the brushes, the jamming of the nodules is prevented and at the same time a cleaning action is performed on the nodules.

23 Claims, 9 Drawing Figures

DEVICE FOR COLLECTING MANGANESE NODULES ON THE OCEAN FLOOR

The invention concerns a device for collecting manganese nodules or the like from the ocean floor.

DE-OS 25 04 694 discloses a self-propelled collecting apparatus for picking up materials lying on the ocean floor, such as, in particular, manganese nodules, having a horizontal cutting device that cuts into the ocean floor and a conveyor mechanism working in conjunction therewith. The cutting tool is attached to an upwardly inclined conveyor chute which conveys the material to a top conveyor, with a scraper chain installed over the conveyor chute. The cutting device not only picks up the manganese nodules lying on the ocean floor, but also cuts off a layer of the ocean floor so that unwanted material such as sand or mud goes along into the upwardly inclined conveyor chute and burdens the latter and the succeeding conveyor means. If the mud is separated from the manganese nodules at a high point and carried back into the water, then, because of its suspension properties it does not resettle immediately and therefore considerably burdens the area of the ocean bottom surrounding the conveying location.

U.S. Pat. No. 3,697,134 discloses a device of the rotating cylinder type in which the means arranged around the circumference of the cylinder for transporting the manganese nodules in the circumferential direction consist of blades that are arranged with their largest dimension in the axial direction of the cylinder and with their smallest dimension in the radial direction. They dig partially into the ocean floor and drive the cylinder. At the same time, they transport the manganese nodules to a point at the top of the cylinder where they fall forward into a basket from which they are then suctioned out through a conveying tube.

In order for the blades to be able to perform their pickup function, they must dig relatively deep into the ocean floor, with the attendant danger that mud will cling to the blades and be carried along. Thus mud then burdens the device and especially the succeeding conveyor path of the manganese nodules. There also exists the drawback that the manganese nodules collect in the area between the cylinder and the enclosing screen in front of each blade and thus lead to the danger of jamming the manganese nodules between the blade and screen and sometimes even between cylinder surface and screen.

It is the object of the invention to provide a device of the kind in question in which only a minumum amount of sediment, such as mud, is picked up and stirred up, so that the burdening of the ocean and the conveyor apparatus with stirred-up mud is kept to a minimum. In addition, the transport of manganese nodules in the area between the cylinder and screen, as well as the cleaning of the mud from the nodules is improved. The device is simple, reliable and dependable in operation.

The invention uses resilient or yielding parts for the collecting of the manganese nodules in order to prevent jamming. This is achieved in particular by having a brush-like means transport the manganese nodules essentially in the order or grouping in which they lie on the ocean floor, so that the danger of clogging and jamming is to a large extent obviated. The brush-like means have the further advantage that they have a loosening effect on foreign deposits on the manganese nodules, i.e., contribute to the loosening of the mud adhering to the nodules.

The bristles of the brush-like means, which are oriented essentially radially to the cylinder, can advantageously form ribs which run more or less parallel or at an acute angle to the axial direction of the cylinder. This produces spaces between the ribs into which even rather large manganese nodules can penetrate easily and deeply and thus be carried away.

The digging rods or teeth on the bottom of the enclosing screen are advantageously made flexible in comparison with the cylinder, thus preventing jamming of nodules that are larger than the distance between brush bottom and enclosing screen. If, however, rather large manganese nodules do get stuck in the opening between cylinder and screen, there is another practical way to remove such manganese nodules in the case of a driven cylinder: just reverse its drive direction so that the opening is brushed free.

In one form of the invention nozzles, fed by water under pressure, are provided inside the cylinder and directed radially through openings in the cylinder surface in order to rinse the brush elements of the cylinder and the manganese nodules transported, clean of sediment. In order to avoid too great a burdening of the ocean with the washed-off sediment it is advantageous to surround the cylinder in the rinse area with a rigid housing which is open only downwardly. Because of the enlarged cross section in this area, the flow velocity of the water leaving the nozzles at high speed is considerably decreased and it flows out at this lower velocity toward the rear of the housing, so that the rinsed-off sediment can settle on the floor behind the cylinder.

The chassis or frame holding the cylinder is advantageously mounted on a sled or vehicle, or constitutes such, so that the cylinder is carried at a quite definite height, and the teeth at the front of the screen, at a quite definite depth into the ocean floor or along its surface. The cylinder may be vertically movable, with the downward force being adjustable by means of weights, springs or the like.

The invention will be further explained with reference to the drawings.

Figure 1:
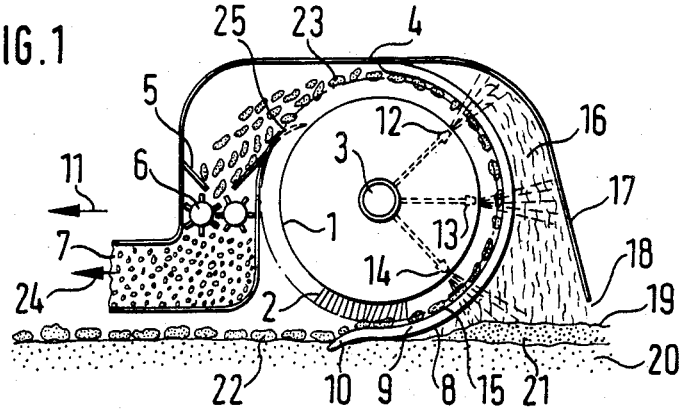
FIG. 1 is a radial section through a device with a brush cylinder according to the invention.

FIG. 1 shows a device according to the invention having a hollow cylinder 1 equipped on its outer surface with bristles 2 made of bronze. The cylinder rotates around an axle 3 inside a housing 4 which at the front includes a funnel 5 and a mill 6 for grinding manganese nodules. The ground-up product is conveyed through a conveyor 7 to the ocean surface by means not shown and of no further interest for the invention.

Figure 3:
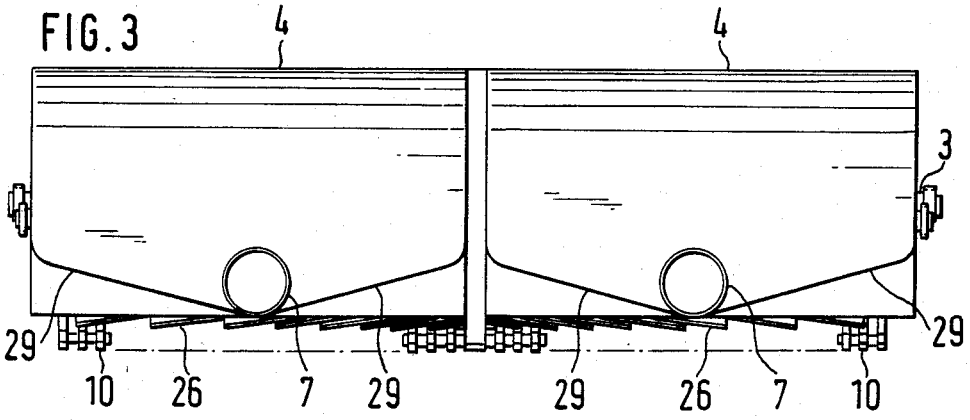
FIG. 3 is a front elevational view of the device of FIG. 1.

The cylinder 1 is partially surrounded rearwardly by an approximately semicircular screen 8 which supports hook-like rods or teeth 9 running in the circumferential direction and terminating in prongs 10 at the bottom pointing in the direction of traction indicated by an arrow 11. (FIGS. 1 and 3).

Mounted inside the cylinder 1 are pressure water-fed nozzles 12, 13 and 14 which are directed radially outwardly toward the interior side of the cylinder wall. The cylinder wall has openings (not depicted in the drawing) through which the jets from the nozzles 12, 13 and 14 are directed toward the bristles 2 and at the same time against the manganese nodules 15 being transported by them, so that both are rinsed free of sediment clinging to the manganese nodules 15 or the bristles 2. The water flows very fast through the screen 8 and into a space 16 behind it that is largely enclosed by a part of the housing 17 down to a bottom slit 18 provided between the housing 17 and a surface 19 of an ocean floor 20. In this space 16 the speed of the water is considerably decelerated, so that washed-off sediment can be deposited in a layer 21 on the ocean floor. In this way the burdening of the surrounding ocean with suspended matter is reduced to a minimum.

In use, the device is towed over the ocean floor 20 in the direction of the arrow 11, whereupon the prongs 10, axially spaced along the cylinder, dig somewhat into the surface and cut under manganese nodules 22 which then are transported by the bristles 2 of the rotating cylinder 1 on the inside of the screen 8 and conveyed upward. This is how the rinsing by the water jets from the nozzles 12, 13 and 14 is done. The screen 8 ends at the top of the cylinder 1, so that manganese nodules 23 are essentially free to drop into the funnel 5, and through the mill 6. The nodules, now a granular size suitable for conveyance by water, are transported through the conveyor line 7 in the direction of the arrow 24 to the ocean surface. In the area in front of the funnel 5 there is provided a comb 25 with teeth which mesh with the bristles 2 and serve to remove manganese nodules that may be stuck in the bristles.

Figure 2:
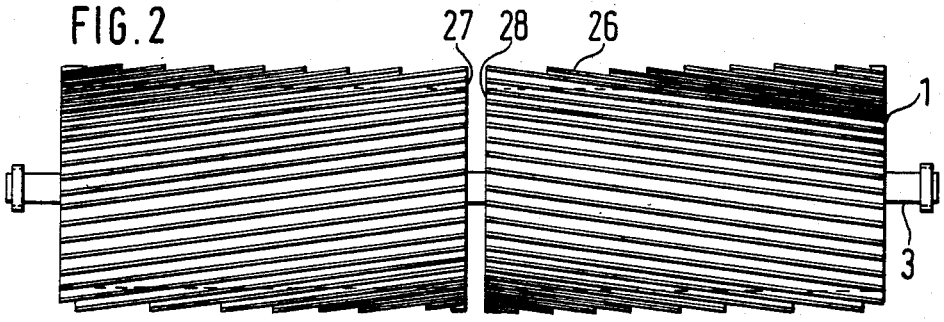
FIG. 2 is a top view of only the brush cylinder of FIG. 1.

FIG. 2 shows the cylinder 1 of FIG. 1 by itself in a top view. It can be seen that the bristles 2 form ribs 26 at somewhat of an angle to the axis 3 of the cylinder. The ribs are at a distance of approximately 50 mm from each other and the ribs are about 10 mm wide, while the length of the bristles is about 50 mm. The bristles terminate at brush bottoms spaced from the screen, rods and prongs as seen in FIG. 1. The cylinder 1 consists of two cylinder segments 27 and 28 whose ribs are inclined in opposite directions in order to neutralize axial forces caused by the inclination.

FIG. 3 is a front view of the device of FIG. 1 in essentially the opposite direction from that of the arrow 11, i.e., contrary to the direction of traction. It can be seen that the housing in the front area has floor surfaces 29 inclined to the conveyor tube 7 that cause the manganese nodules to slide toward the conveyor tube 7.

Figure 4:
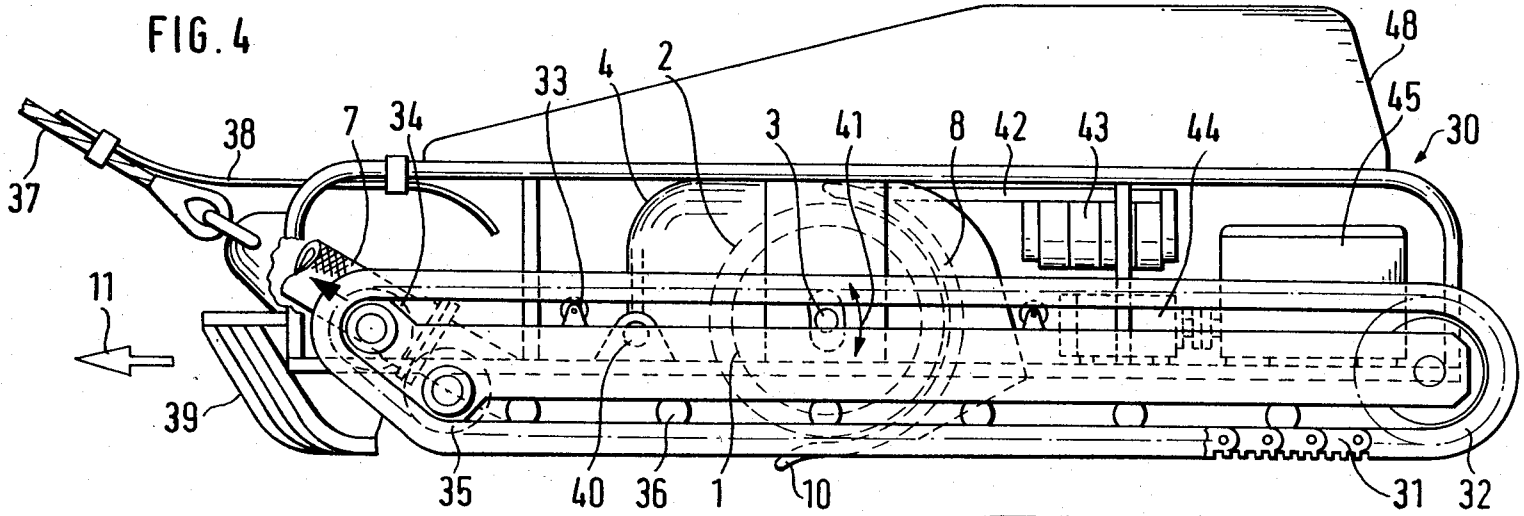
FIG. 4 shows the device of FIG. 1 mounted in a tracked vehicle.

FIG. 4 shows the arrangement of the device of FIG. 1 in a vehicle 30 that has tracks that are trained over wheels 32, 33, 34, 35 and 36. The vehicle 30 is towed with a tow rope 37, to which a power supply line 38 and also the conveyor tube 7 are connected. On the front end of the vehicle there is a bumper 39 which comes into play in the presence of large objects on the ocean floor.

The device in FIG. 1 is suspended on a front swivel joint 40 so as to pivot vertically in the direction of the double arrow 41, with the prongs 10 extending under the bottom track 31 so that they can pentrate into the ocean floor. Mounted on the frame holding the axle 3 of the cylinder 1 there is an arm 42 to which are attached weights 43 that force the cylinder 1 with the screen 8 downwards in order to increase the contact pressure. Also provided is an electric motor 44 fed by the power supply line 38, which drives a hydraulic motor 45 which serves for the control and even for driving the whole vehicle, if so desired.

Figure 5:
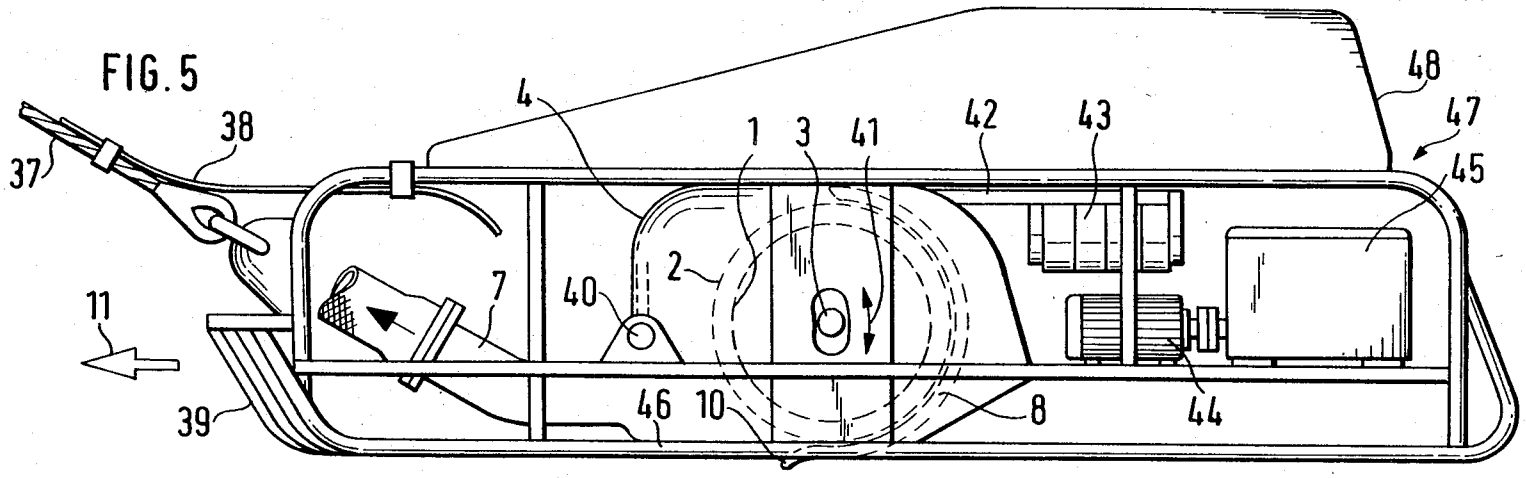
FIG. 5 shows the device of FIG. 1 mounted in a sled.

FIG. 5 corresponds essentially to FIG. 4. Identical parts are given identical reference numbers. In the version of FIG. 5, however, the tracks 32 and the parts that work in conjunction with them are left out. Instead, the bumper 39 is extended rearward and forms runners 46 to produce a sled 47.

In both versions of FIGS. 4 and 5 there is a fin 48 on top for stabilizing the device when being lowered and also when being towed.

Figure 6:
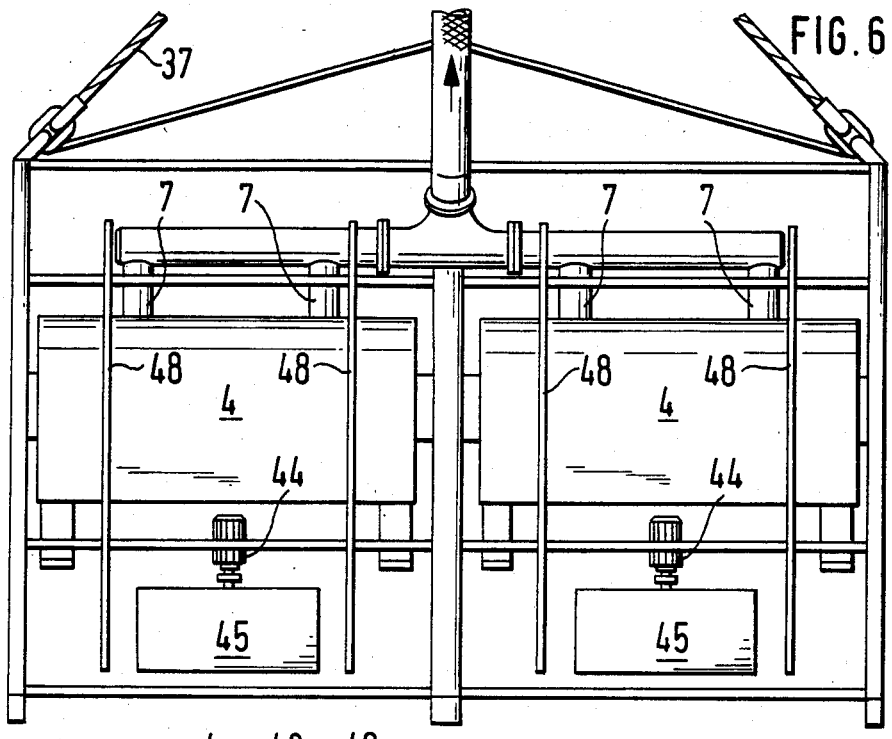
FIG. 6 is a compressed top view of FIG. 5.

FIG. 6 is a top view of the device of FIG. 5. Identical parts are indicated with identical numbers. It can be seen that two assemblies of FIG. 3 are installed in the sled 47, so that a greater width of the ocean floor can be covered and stripped.

Figure 7:
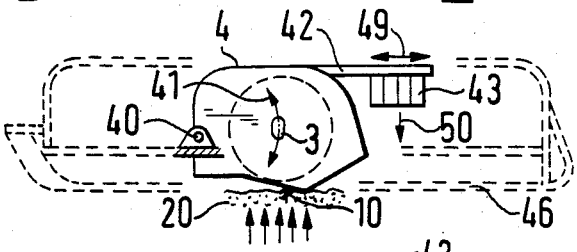
FIGS. 7 to 9 are different embodiments of the contact pressure adjustment of the device of FIG. 1 mounted in a sled according to FIG. 5.

FIG. 7 shows schematically and in reduced form the assembly of FIG. 5, so that the pivoting suspension of FIG. 1 can be clearly seen. The weights 43 are adjustable in the direction of the double arrow 49, so that the downward force in the direction of the arrow 50 with which the prongs dig into the ocean floor 20 is adjustable.

Figure 8:
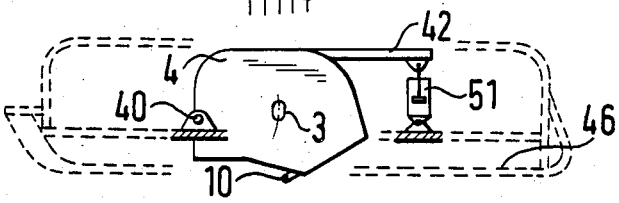

In the version of FIG. 8, which corresponds to FIG. 7, except that weights 43 have been replaced by a hydraulic cylinder by means of which the distance which the prongs 10 project below the runners 46 can be adjusted.

Figure 9:
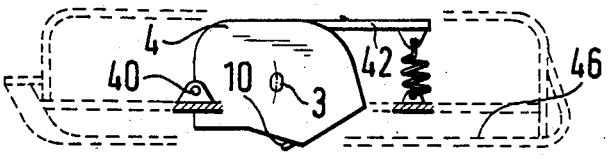

FIG. 9 shows a further variation of the embodiment represented schematically in FIG. 7, wherein instead of the weights 43, a tension spring 52 is provided. If weight relief is desired, the spring 52 can also be a compression spring.

What is claimed is:

1. A device for collecting nodules from the ocean floor comprising a frame to be towed over the ocean floor in a direction of traction;

a cylinder mounted for rotation about a horizontal axis on said frame;

the cylinder having a surface, a front half facing the direction of traction, a rear half away from the direction of traction, a top above the axis and a bottom below the axis, the cylinder rotating in relation to the direction of traction such that the top of the cylinder rotates in the direction of traction and the bottom of the cylinder rotates away from the direction of traction;

a semicylindrical screen surrounding the rear half of said cylinder;

hook-like rods mounted on said screen terminating at their ends in prongs pointing downward and forwardly in direction of traction, the prongs being axially spaced along the cylinder and positioned to dig and cut under the nodules;

means mounted forwardly of said cylinder for conveying nodules picked up by said cylinder; and brushes on the surface of said cylinder comprising bristles aligned in ribs, the bristles extending radially outward of the surface to form brush bottoms, the brush bottoms being spaced from the screen, rods and prongs, for providing a distance for nodules between the brush bottoms and screen such that nodules are transported between the brush bottoms and screen, the brushes being for transporting manganese nodules from the ocean floor after the nodules are cut under by the prongs to said conveying means.

2. The device of claim 1 in which said brushes comprise bristles arranged in the form of ribs extending approximately parallel to the cylinder axis.

3. The device of claim 2 which said ribs form an acute angle to the axis of the cylinder.

4. The device of claim 2 in which the ribs are spaced about 50 mm apart.

5. The device of claim 2 in which the ribs are about 10 mm wide.

6. The device of claim 2 in which the bristles are about 50 mm in length.

7. The device of claim 2 in which the bristles are made of bronze .

8. The device of claim 1 in which said prongs are resilient in comparsion with the cylinder.

9. The device of claim 1 in which the cylinder is impermeable to manganese nodules.

10. The device of claim 1 which includes a comb disposed between the top of said screen and said conveying means, the teeth of said comb extending toward the face of said cylinder and meshing with the brushes.

11. The device of claim 1 which includes means mounted just above said conveying means for catching falling manganese nodules and directing them into said conveying means.

12. The device of claim 11 in which said catching means includes a mill for crushing the nodules.

13. The device of claim 11 which includes a housing surrounding and spaced rearwarly from said screen.

14. The device of claim 1 in which said cylinder is hollow and which inclues nozzles mounted inside said cylinder directed radially toward said screen, an opening through the cylinder wall opposite each nozzle, and pump means connecting to said nozzles.

15. The device of claim 14 which includes a housing surrounding and spaced rearwardly from said screen, said housing having an opening toward the ocean floor on a level with the bottom of said cylinder.

16. The device of claim 1 in which said frame constitutes a sled or a vehicle for conveying the device.

17. The device of claim 16 in which the axle of said cylinder is mounted for vertical movement in slots on the frame.

18. The device of claim 17 which includes means for height adjustment of the cylinder and for exerting a downward force on the cylinder, said means acting upon the axle in said slots.

19. The device of claim 17 in which said height-adjusting means includes a lever hinged at one end of the frame and said slots are disposed in said lever, and a weight on the other end of the said lever to apply a downward force to the cylinder and the rods.

20. The device of claim 19 in which said weight is replaced by a spring or a hydraulic cylinder.

21. The device of claim 16 in which two devices are assembled side by side.

22. The device of claim 16 which includes a stabilizing fin extending upwardly from the frame above said cylinder.

23. The device of claim 1 which includes means for driving said cylinder either forward or backward.

* * * * *